US008157359B2

(12) United States Patent
Ozawa et al.

(10) Patent No.: US 8,157,359 B2
(45) Date of Patent: Apr. 17, 2012

(54) LIQUID EJECTING HEAD AND PRINTER

(75) Inventors: Kinya Ozawa, Shiojiri (JP); Hayato Takahashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1082 days.

(21) Appl. No.: 12/030,419

(22) Filed: Feb. 13, 2008

(65) Prior Publication Data

US 2008/0198204 A1 Aug. 21, 2008

(30) Foreign Application Priority Data

Feb. 13, 2007 (JP) ..... 2007-032061

(51) Int. Cl.
*B41J 2/045* (2006.01)

(52) U.S. Cl. ..... 347/70; 347/71

(58) Field of Classification Search ..... 347/1, 5, 347/9–17, 19–20, 22, 27, 40, 42, 44, 47–48, 347/54, 56–58, 63–64, 67–75, 84–85, 94, 347/101, 104; 128/200.14, 200.16; 137/38, 137/43, 247, 251.1; 222/23, 36, 102.1, 102.2, 222/420; 29/25.35; 310/300, 311, 314, 317, 310/321, 324, 328, 330–332, 345, 363–367; 427/58, 100; 438/21

See application file for complete search history.

(56) References Cited

U.S. PATENT DOCUMENTS

| | | | | |
|---|---|---|---|---|
| 3,611,831 | A * | 10/1971 | O'Neill | 74/574.1 |
| 5,212,988 | A * | 5/1993 | White et al. | 73/599 |
| 6,530,652 | B1 * | 3/2003 | Kim et al. | 347/70 |
| 2003/0117463 | A1 * | 6/2003 | Kitahara | 347/68 |
| 2006/0077237 | A1 * | 4/2006 | Shin et al. | 347/71 |

FOREIGN PATENT DOCUMENTS

| | | | |
|---|---|---|---|
| JP | 01299048 | A * | 12/1989 |
| JP | 03-010846 | | 1/1991 |
| JP | 08-164607 | | 6/1996 |
| JP | 09-039234 | | 2/1997 |
| JP | 2004-160941 | | 6/2004 |
| WO | 99/00252 | | 1/1999 |

* cited by examiner

*Primary Examiner* — Charlie Peng
*Assistant Examiner* — Peter Radkowski
(74) *Attorney, Agent, or Firm* — Workman Nydegger

(57) ABSTRACT

A liquid ejecting head includes a first pressure chamber, a second pressure chamber provided at a side of the first pressure chamber, a vibration plate provided above the first pressure chamber and the second pressure chamber, a driving piezoelectric element provided above the first pressure chamber and above the vibration plate, and a non driving piezoelectric element provided above the second pressure chamber and above the vibration plate.

17 Claims, 5 Drawing Sheets

LIQUID EJECTING HEAD AND PRINTER

CROSS REFERENCE TO RELATED APPLICATION

This application claims the priority of Japanese Patent Application No. 2007-32061, filed Feb. 13, 2007, which is incorporated herein by reference.

BACKGROUND

1. Technical Field

The present invention relates to a liquid ejecting head and a printer.

2. Related Art

A liquid ejecting head is used for a head of an ink jet printer or the like and is a main device in printing of an ink jet type for ejecting and applying ink to a recording paper.

Generally, the liquid ejecting head has a multi channel structure equipped with a plurality of sets (channels) of an ejecting orifice and a piezoelectric element corresponding to the ejecting orifice. In the liquid ejecting head, liquid is ejected from the ejecting orifice by a predetermined amount and at a predetermined timing in accordance with the operation of the piezoelectric element for every channel. It is required for the liquid ejecting head to reduce the distance between adjacent channels (density growth) in addition to have a capability of ejecting a smaller liquid drop at a more precise timing.

The density growth of the liquid ejecting head may eject a liquid drop from the adjacent channel caused by the influence of the vibration of the piezoelectric element operated when ejecting liquid from a channel. To cope with such a disadvantage, for example, in JP-A-8-164607, an ink jet head is disclosed in which a column member formed by a piezoelectric element is provided between liquid chambers in which liquid is filled and in which operation of one piezoelectric element is to be not transmitted to the adjacent channel by bonding the column member with a substrate.

A phenomenon in which liquid is unintentionally ejected, for example, liquid is ejected from an ejecting orifice which is not driven when ejecting liquid from an ejecting orifice is called as crosstalk. The crosstalk becomes one of obstacle in the density growth of the liquid ejecting head.

In order to restrain the crosstalk, it is important to enhance the rigidity of the liquid ejecting head. In order to enhance the rigidity of the liquid ejecting head, it is important to strength a movable part that is directly concerned with application of pressure to liquid rather than to strength a fixed part that is not concerned with application of pressure to liquid. As for the reason, the crosstalk is a phenomenon that occurs when the vibration generated when a piezoelectric element is operated is transmitted to the adjacent channel, and the part which is easily influenced by the vibration is the movable part.

SUMMARY

The object of the invention is to provide a liquid ejecting head in which crosstalk is restrained and a printer equipped with the same.

The liquid ejecting head of the invention includes a first pressure chamber, a second pressure chamber provided at a side of the first pressure chamber, a vibration plate provided above the first pressure chamber and the second pressure chamber, a driving piezoelectric element provided above the first pressure chamber and above the vibration plate, and a non driving piezoelectric element provided above the second pressure chamber and above the vibration plate.

Other features and objects of the invention except the aforementioned ones will be apparent from the following description with reference to the accompanying drawings.

BRIEF DESCRIPTION OF THE DRAWINGS

For a more complete understanding of the invention and advantages thereof, reference is made to the following description and accompanying drawings, in which.

DESCRIPTION OF EXEMPLARY EMBODIMENTS

At least the following matters will be apparent by the present specification and the accompanying drawings.

A liquid ejecting head of the invention includes a first pressure chamber, a second pressure chamber provided at a side of the first pressure chamber, a vibration plate provided above the first pressure chamber and the second pressure chamber, a driving piezoelectric element provided above the first pressure chamber and above the vibration plate, and a non driving piezoelectric element provided above the second pressure chamber and above the vibration plate.

Crosstalk is sufficiently restrained in the liquid ejecting head structured in this manner.

Note that, in the invention, when described that particular B member is provided above particular A member, it means to include the case that B member is directly provided above A member and the case that B member is provided above A member via another member.

The first pressure chamber and the second pressure chamber of the liquid ejecting head of the invention may be a space surrounded by the vibration plate, a plate like member which becomes a partition wall between the first pressure chamber and the second pressure chamber, and a nozzle plate provided below the plate like member and equipped with a nozzle orifice.

The liquid ejecting head of the invention may further include another non driving piezoelectric element provided above the first pressure chamber and above the vibration plate.

The liquid ejecting head of the invention may further include another driving piezoelectric element provided above the second pressure chamber and above the vibration plate.

The liquid ejecting head of the invention may further include a support plate provided above the vibration plate and equipped with a through hole, and a diaphragm provided above the vibration plate and provided inside the through hole.

A printer of the invention includes the aforementioned liquid ejecting head. The printer of the invention may include a head unit having the aforementioned liquid ejecting head, a driving unit for reciprocating the head unit, and a control unit for controlling the head unit and the driving unit.

Hereinafter, a preferred embodiment of the invention will be described with reference to the drawings. Note that the embodiment described below is described as an example of the invention. Accordingly, it is not necessarily the case that all of the structures to be described are indispensable constituent elements.

1. Liquid Ejecting Head

Figure 1:
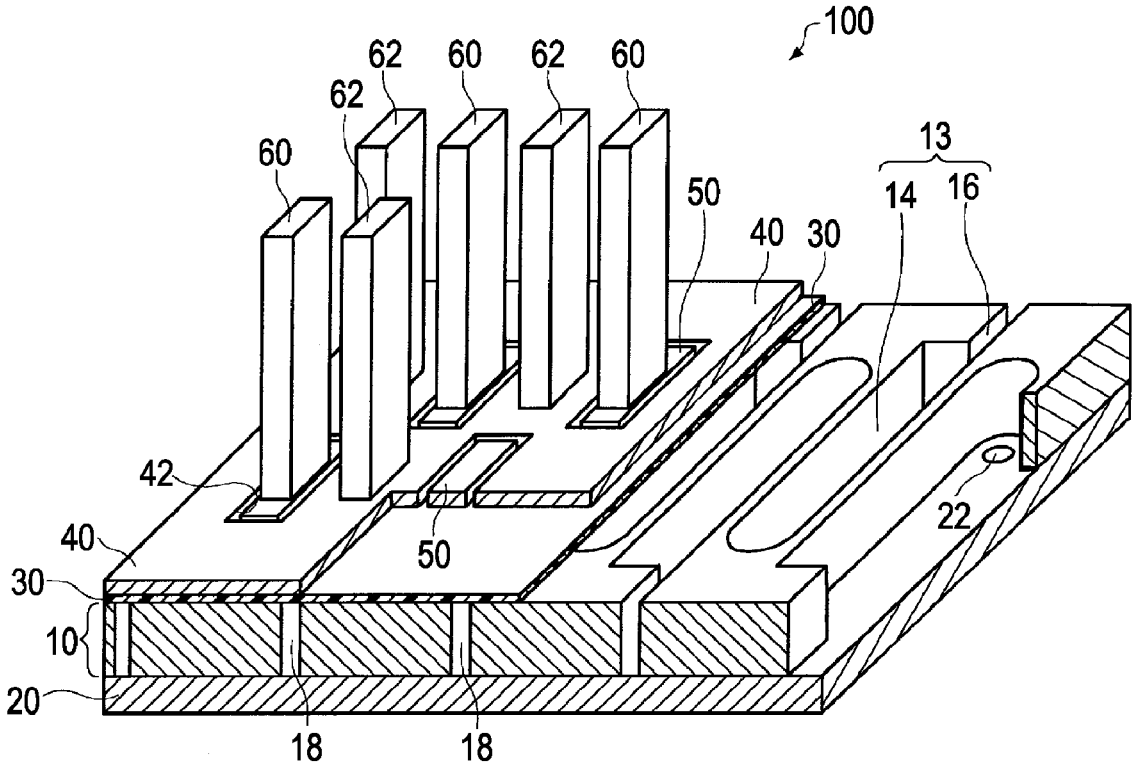
FIG. 1 is a partial cut perspective view schematically showing a liquid ejecting head 100 of the embodiment.
Figure 2:
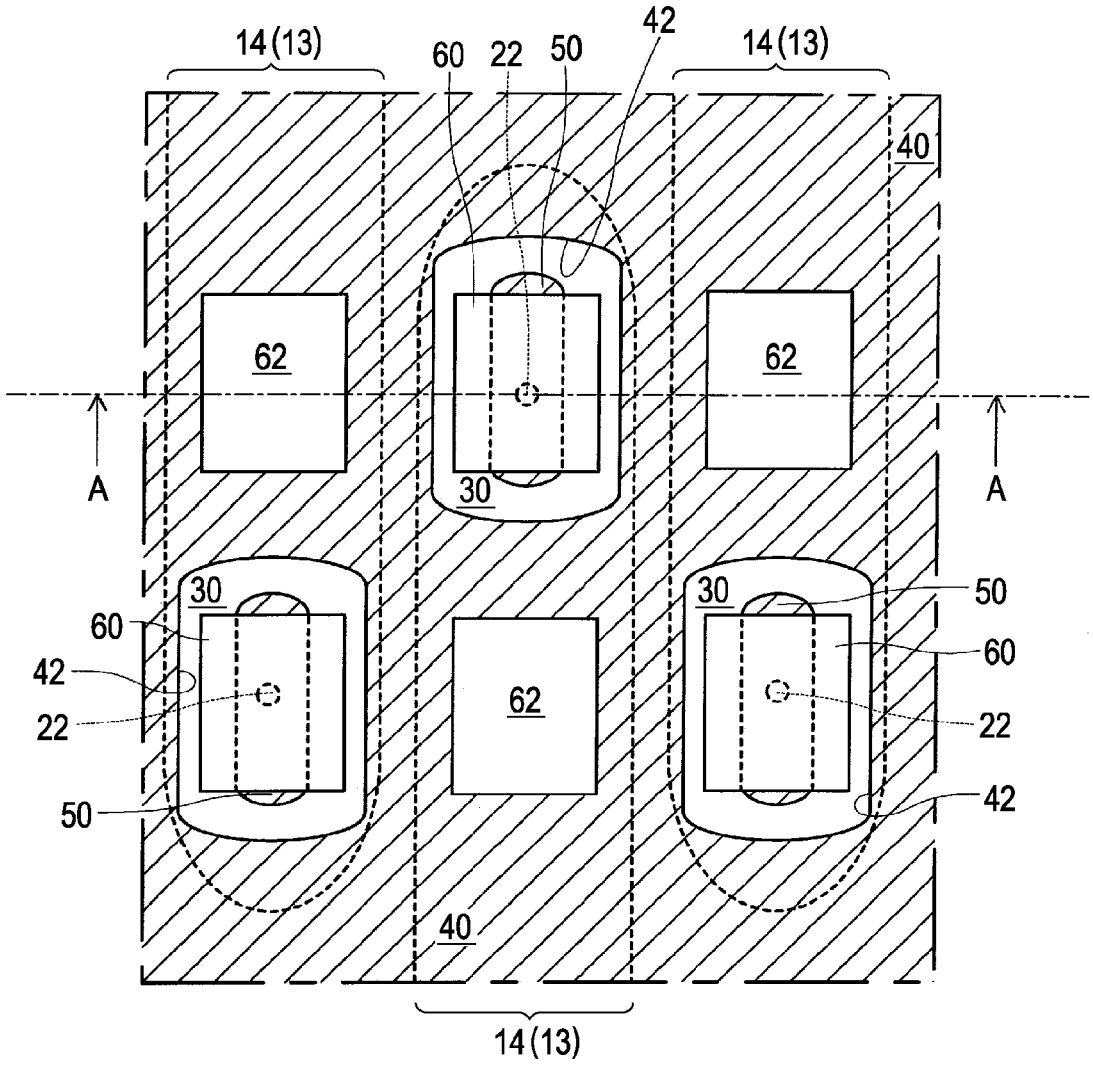
FIG. 2 is a plan view schematically showing a plate like member 10 of the embodiment.
Figure 3:
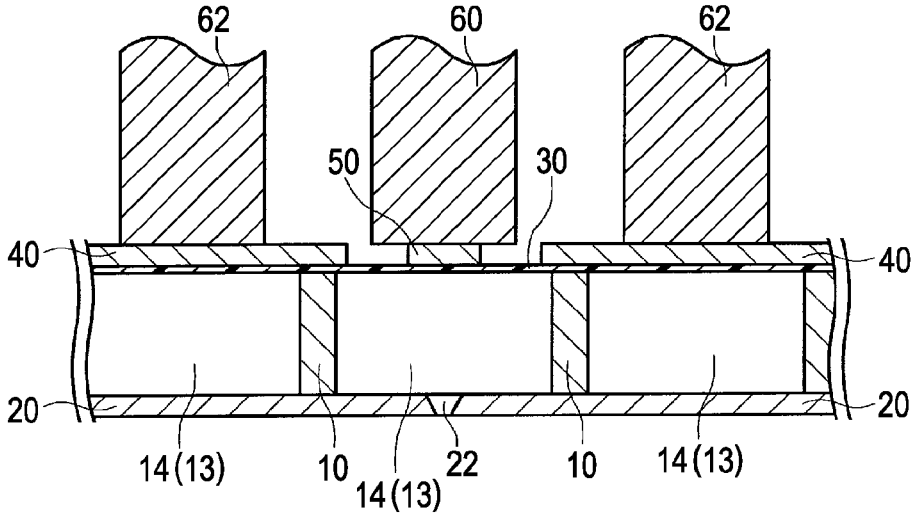
FIG. 3 is a plan view schematically showing a configuration of a plate like member, a driving piezoelectric element, and a non driving piezoelectric element.
Figure 4:
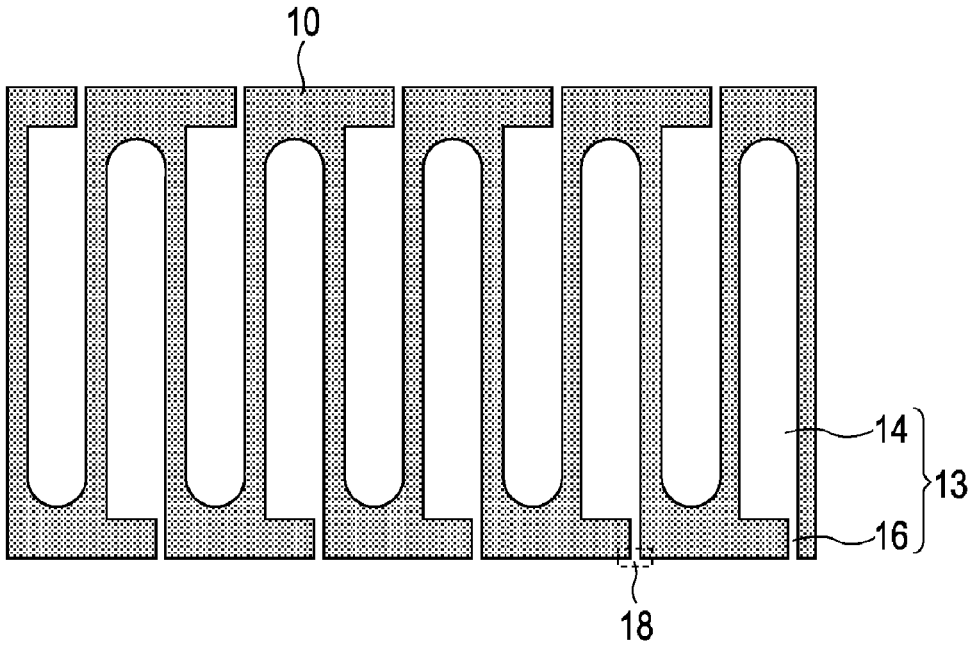
FIG. 4 is a plan view schematically showing the liquid ejecting head 100 of the embodiment.
Figure 5:
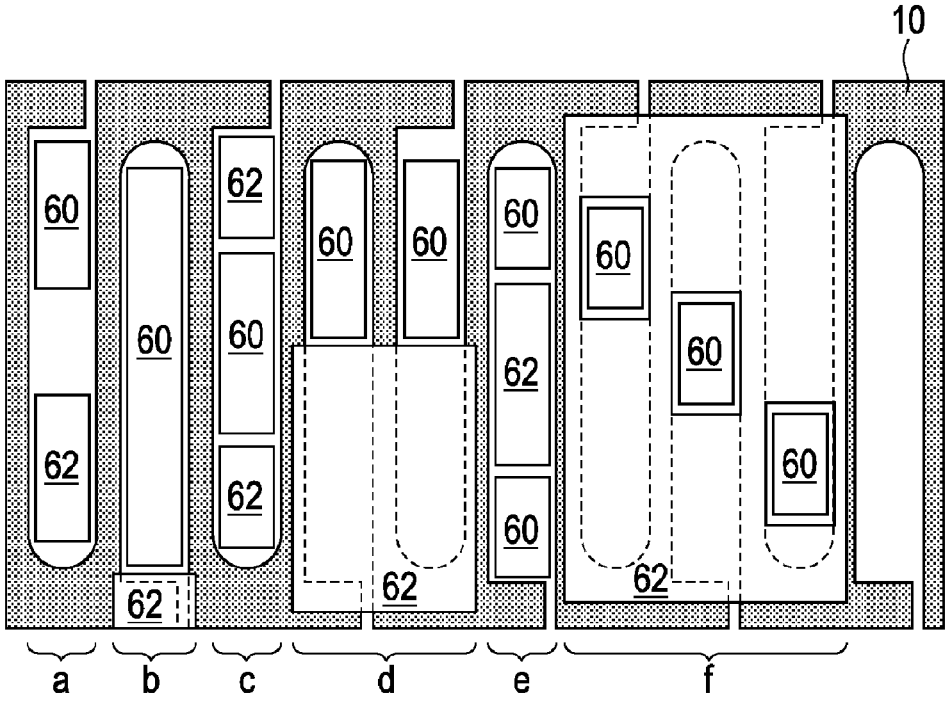
FIG. 5 is a cross sectional view taken along the line A-A of FIG. 6.

FIG. 1 is a partial cut perspective view schematically showing a liquid ejecting head 100 of the embodiment. FIG. 2 is a plan view schematically showing the liquid ejecting head 100. FIG. 3 is a cross sectional view schematically showing the liquid ejecting head 100. FIG. 3 is a cross sectional view taken along the line A-A of FIG. 2. FIG. 4 and FIG. 5 are each a plan view schematically showing a plate like member 10.

As shown in FIGS. 1 to 3, the liquid ejecting head 100 of the embodiment includes a plate like member 10, a nozzle plate 20, a vibration plate 30, a support plate 40, diaphragms 50, driving piezoelectric elements 60, and non driving piezoelectric elements 62.

The plate like member 10 is a member having a plate shape that becomes a partition wall of a pressure chamber 13. The nozzle plate 20 is provided below the plate like member 10, and the vibration plate 30 is provided above the plate like member 10. Accordingly, the plate like member 10 is sandwiched by the nozzle plate 20 and the vibration plate 30. Consequently, an inner space is formed by the plate like member 10, the nozzle plate 20, and the vibration plate 30. The space becomes the pressure chamber 13. As shown in FIG. 3, the plate like member 10 has a function as a partition wall and adjacent pressure chambers 13 are separated to each other by the plate like member 10. As the material of the plate like member 10, for example, silicon, stainless, SUS, nickel, titanium, titanium alloy, or the like can be used.

The nozzle plate 20 is provided below the plate like member 10. The nozzle plate 20 may be provided so as to be attached firmly to the plate like member 10 or may be provided via an adhesive agent or another member. The nozzle plate 20 has a nozzle orifice 22 communicating with the pressure chamber 13. A surface among the upper surface of the nozzle plate 20 which does not make contact with the plate like member 10 constitutes the lower surface of the pressure chamber 13. As the material of the nozzle plate 20, for example, silicon, stainless, titanium, titanium alloy, or the like can be used.

The vibration plate 30 is provided above the pressure chamber 13. The vibration plate 30 constitutes the upper surface of the vibration plate 30. Another member may be provided below the vibration plate 30 to constitute the upper surface of each pressure chamber. By vibrating at least a part of the surface constituting the upper surface of the pressure chamber 13 among the vibration plate 30 up and down, the volume of each pressure chamber can be changed. The material of the vibration plate 30 only needs to have a predetermined flexibility. For example, a high-polymer material such as polyimide is preferable.

The pressure chamber 13 is a space formed by the nozzle plate 20, the vibration plate 30, and the plate like member 10 sandwiched between the nozzle plate 20 and the vibration plate 30. The pressure chamber 13 is constituted by a pressure portion 14 and a narrowed portion 16 (see FIGS. 1 and 4). The pressure chamber 13 has an opening 18 at an end face of the plate like member 10. The pressure chamber 13 is communicated with an exterior liquid reservoir (not shown) via the opening 18. The vicinity of the opening 18 of the pressure chamber 13 is the narrowed portion 16 whose shape is narrowed, which makes it difficult to dissipate the pressure generated inside the pressure chamber 13 from the opening 18. Liquid is supplied to the narrowed portion 16 and the pressure portion 14 from the liquid reservoir through the opening 18. Accordingly, the narrowed portion 16 also has a function of a flow path of the liquid. The nozzle orifice 22 is communicated with each pressure chamber 13. One pressure chamber 13 may have a plurality of narrowed portions 16 and may have a plurality of openings 18. Further, pluralities of the pressure chambers 13 may have a common one opening 18. The narrowed portion 16 can be transformed into any shape in accordance with a factor such as the shape of the pressure chamber 13, the viscosity of the liquid, or the like. A different type liquid can be respectively filled in the plurality of pressure chambers 13. In the example shown in FIGS. 1 to 3, the shape of the pressure chamber 13 is a shape in which the narrowed portion 16 is provided at one end of the pressure portion 14 having an elongated shape. In the example shown in the drawings, such pressure chambers 13 are arranged in parallel. The narrowed portion 16 of each pressure chamber 13 is provided at the position opposite to the position at which the narrowed portion 16 of the adjacent pressure chamber 13 is provided. The shape of the pressure chamber 13 may be a shape which is different from the exemplified shape, and for example, may be a radial shape or a honeycomb shape.

The driving piezoelectric element 60 is provided above the pressure chamber 13 and above the vibration plate 30 (see FIGS. 1 to 3). The driving piezoelectric element 60 may be provided above the vibration plate 30 via another member such as the diaphragm 50, an adhesive agent, or the like. An upper portion of the driving piezoelectric element 60 is fixed to a housing (omitted in the drawings) or the like. The driving piezoelectric element 60 is elongated and contracted in the up and down direction in accordance with an electronic signal to be applied to vibrate the vibration plate 30 up and down. The length of the driving piezoelectric element 60 in the up and down direction is determined depending on the performance of the piezoelectric body of the driving piezoelectric element 60 or the like. The driving piezoelectric element 60 has a structure in which the piezoelectric body is sandwiched by electrodes. The extending direction of the electrodes of the driving piezoelectric element 60 may be parallel (horizontal mode) to or may be perpendicular (vertical mode) to the elongation and contraction direction of the driving piezoelectric element 60. The driving piezoelectric element 60 may have an integrated circuit at the side surface or the like. As for the material of the piezoelectric body of the driving piezoelectric element 60, any material is available as long as the material shows piezoelectricity. For example, lead zirconate titante (PZT) including Pb, Zr, Ti as constituent elements or the like may be preferably used. Further, as for the material of the piezoelectric body, lead zirconate titanate niobate in which Nb is further doped to PZT or the like can be preferably used. As for the material of the electrodes of the driving piezoelectric element 30, any material may be available as long as the material has conductive property. For example, platinum or the like may be used.

The non driving piezoelectric element 62 is provided above the pressure chamber 13 and above the vibration plate 30. The non driving piezoelectric element 62 may be provided beyond the area vertically above the pressure chamber 13. Further, the non driving piezoelectric element 62 may be provided above another adjacent pressure chamber 13 beyond the pressure chamber 13. The non driving piezoelectric element 62 may be provided so as to be mechanically attached firmly to the support plate 40 or may be provided via another member such as the support plate 40, an adhesive agent, or the like. An upper portion of the non driving piezoelectric element 62 is fixed to a housing (not shown) or the like. The non driving piezoelectric element 62 may have any length in the up and down direction as long as the upper portion thereof can be fixed to the housing. The non driving piezoelectric element 62 is not elongated and contracted to be deformed. The non driving piezoelectric element 62 has a function to mechanically strengthen the liquid ejecting head 100. Accordingly, the vibration plate 30 below the non driving piezoelectric element 62 is fixed by the non driving piezoelectric element 62. Further, the plate like member 10 below the non driving piezoelectric element 62 is also fixed by the non driving piezoelectric element 62 in a similar way. By the effects, vibration of the vibration plate 30 below the non driving piezoelectric element 62 is restrained. Consequently, needless vibration of the liquid ejecting head 100 is restrained when ejecting liquid and crosstalk is reduced. Further, when the non driving piezoelectric element 62 is provided beyond the area vertically above the pressure chamber 13, the mechanical strength of the entire non driving piezoelectric element 62 is further increased and crosstalk is further reduced.

Any material may be used for the non driving piezoelectric element 62. For example, the material of the non driving piezoelectric element 62 may be the same as or different from the driving piezoelectric element 60. When the materials of the non driving piezoelectric element 62 and the driving piezoelectric element 60 are the same, the both elements can be formed at the same time, so that the manufacturing process can be simplified. When the non driving piezoelectric element 62 and the driving piezoelectric element 60 are the same, it is required that at least no electric signal is applied to the non driving piezoelectric element 62 in order not to deform the non driving piezoelectric element 62 by elongation and contraction or the like.

The driving piezoelectric element 60 and the non driving piezoelectric element 62 can be respectively provided above another pressure chamber 13 provided at a side of the pressure chamber 13. Further, the driving piezoelectric element 60 and the non driving piezoelectric element 62 can be provided above one pressure chamber 13.

The support plate 40 can be provided above the vibration plate 30 (see FIGS. 1 to 3). The support plate 40 may be provided so as to be mechanically attached firmly to the vibration plate 30 or may be provided via an adhesive agent or another member. The support plate 40 has a plurality of through holes 42. At least one of the pluralities of through holes 42 is provided in the area vertically above each pressure chamber 13 (see FIG. 2). The through hole 42 is provided so that the movement of the driving piezoelectric element 60 can be transmitted to the vibration plate 30. As for the material of the support plate 40, for example, silicon, stainless, titanium, titanium alloy, or the like can be used. The through hole 42 is provided in the area vertically above each pressure chamber 13 (the area which is not held by the plate like member 10 below the support plate 40) and plurality number of the through holes 42 can be provided in the area vertically above one pressure chamber 13 as necessary. A portion of the vibration plate 30 exposed by the through hole 12 can be vibrated by deflection in the upper and lower direction. The volume of the pressure chamber 13 is changed by the vibration of the exposed portion of the vibration plate 30. The equipment of the support plate 40 further enhances the function of restraining the vibration of the vibration plate 30 under the support plate 40. Herewith, crosstalk can be further reduced when ejecting liquid. The support plate 40 can be eliminated in the liquid ejecting head 100.

The diaphragm 50 can be provided above the vibration plate 30. The diaphragm 50 may be provided on the vibration plate 30 via an adhesive agent or another member. The diaphragms 50 are respectively provided inside the plurality of through holes 42 one by one so as not to make contact with the support plate 40 (see FIGS. 1 to 3). When a plurality of through holes 42 (diaphragms 50) are provided on one pressure chamber 13, the range of the volume to be changed of the pressure chamber 13 can be expanded, and the volume of a liquid drop to be ejected can be enlarged. Further, in this case, the volume of a liquid drop to be ejected can be finely adjusted by combining the operations of the plurality of diaphragms 50.

The diaphragm 50 has a shape by which the diaphragm 50 does not make contact with the support plate 40 even when vibrated up and down. The diaphragm 50 can be vibrated with the vibration plate 30 and has a function to evenly transmit the vibration generated by the driving piezoelectric element 60 to the vibration plate 30. In the case of the through hole 42 having the shape as shown in FIG. 3, the diaphragm 50 may have a shape slightly smaller than the through hole 42. The material of the diaphragm 50 is, for example, silicon, stainless, titanium, titanium alloy, or the like, and may be the same as or different from that of the support plate 40. The diaphragm 50 may be eliminated in the liquid ejecting head 100.

Configurations of the driving piezoelectric element 60 and the non driving piezoelectric element 62 will be described with reference to FIG. 5. Only the plate like member 10, the driving piezoelectric elements 60, and the non driving piezoelectric elements 62 are drawn in a plane manner in FIG. 5 for the sake of illustration. Symbols a to f are appended at the lower part of FIG. 5 and the configurations of the driving piezoelectric element 60 and the non driving piezoelectric element 62 are separately shown for every pattern.

Each of the examples of the configuration pattern shown in FIG. 5 is a configuration pattern that may constitute a part of the liquid ejecting head 100. Accordingly, each of the configuration of the pressure chamber 13, the driving piezoelectric element 60, and the non driving piezoelectric element 62 arranged in the liquid ejecting head 100 may shall be the one in which any one of the configuration patterns shown in the drawing is repeated or the one in which different configuration patterns are combined. Hereinafter, each of the configuration patterns will be described.

The configuration pattern shown by symbol a of FIG. 5 is an example in which the entire of one driving piezoelectric element 60 and the entire of one non driving piezoelectric element 62 are provided in the area vertically above one pressure chamber 13. The one in which such a configuration pattern is alternately continued is the entire configuration as shown in FIG. 3. The configuration pattern shown by symbol b of FIG. 5 is an example in which the entire of one driving piezoelectric element 60 and a part of the non driving piezoelectric element 62 are provided in the area vertically above one pressure chamber 13. The configuration pattern shown by symbol c of FIG. 5 is an example in which the entire of one driving piezoelectric element 60 and the entire of each of two non driving piezoelectric elements 62 are provided in the area vertically above one pressure chamber 13. The configuration pattern shown by symbol d of FIG. 5 is an example in which driving piezoelectric elements 60 are provided in the area vertically above two adjacent pressure chambers 13 one by one and a part of one non driving piezoelectric element 62 is provided in the area vertically above the adjacent pressure chambers 13. In this example, two adjacent pressure chambers 13 are drawn. However, the configuration pattern can be applied to the consecutive pressure chambers 13 whose number is not less than three. The configuration pattern shown by symbol e of FIG. 5 is an example in which the entire of each of two driving piezoelectric elements 60 and the entire of one non driving piezoelectric element 62 are provided in the area vertically above one pressure chamber 13. The configuration pattern shown by symbol f of FIG. 5 is an example in which driving piezoelectric elements 60 are provided in the area vertically above three adjacent pressure chambers 13 one by one, one non driving piezoelectric element 62 surrounding the circumference of each of the driving piezoelectric elements 60 is provided, and a part of the non driving piezoelectric element 62 is provided in the area vertically above the adjacent pressure chambers 13.

Figure 6:
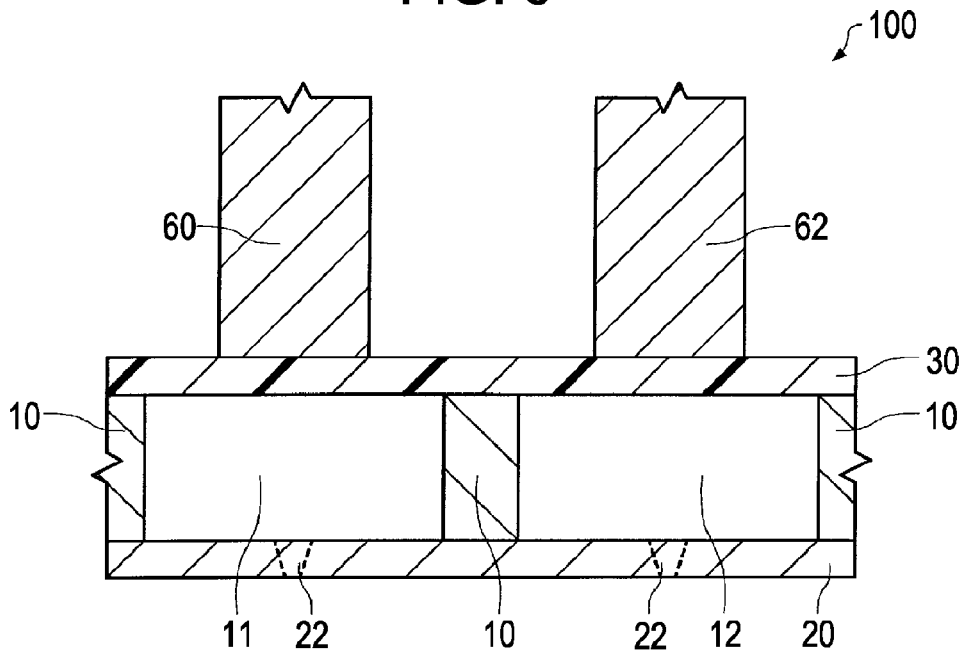
FIG. 6 is a cross sectional view schematically showing a basic structure of the liquid ejecting head 100 of the embodiment.
Figure 7:
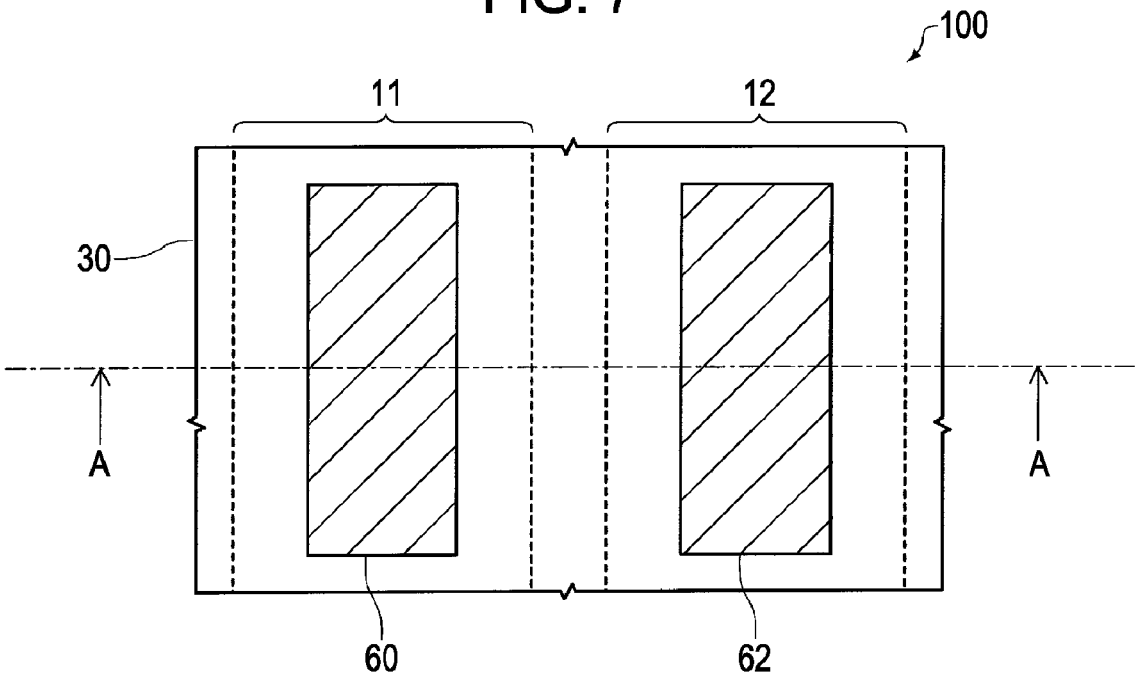
FIG. 7 is a plan view schematically showing a basic structure of the liquid ejecting head 100 of the embodiment.

Next, a basic structure of the liquid ejecting head 100 of the embodiment will be described with reference to FIGS. 6 and 7. FIG. 6 is a cross sectional view schematically showing the basic structure of the liquid ejecting head 100 of the embodiment. FIG. 7 is a plan view schematically showing the basic structure of the liquid ejecting head 100 of the embodiment. The cross section taken along the line A-A of FIG. 7 corresponds to FIG. 6.

In the basic structure of the liquid crystal device 100 of the embodiment, as shown in FIGS. 6 and 7, there are included the vibration plate 30 provided above a first pressure chamber 11 and a second pressure chamber 12, the driving piezoelectric element 60 provided above the first pressure chamber 11 and above the vibration plate 30, and the non driving piezoelectric element 62 provided above the second pressure chamber 12 and above the vibration plate 30.

In the basic structure of the liquid ejecting head 100, the aforementioned pressure chambers 13 will be described by separating into the first pressure chamber 11 and the second pressure chamber 12 for the sake of convenience. Accordingly, the first pressure chamber 11 and the second pressure chamber 12 may correspond to each of the aforementioned pressure chambers 13.

The first pressure chamber 11 has an upper surface, side surfaces, and a lower surface. For example, as shown in FIG. 6, the upper surface of the first pressure chamber 11 is constituted by the vibration plate 30. Further, the side surfaces of the first pressure chamber 11 are constituted by, for example, the plate like member 10. The lower surface of the first pressure chamber 11 is constituted by the nozzle plate 20. The plate like member 10, the nozzle plate 20 and the vibration plate 30 are the same as the aforementioned ones.

The second pressure chamber 12 is provided at a side of the first pressure chamber 11. The second pressure chamber 12 has an upper surface, side surfaces, and a lower surface similar to the first pressure chamber 11. The structure of each surface is similar to that of the first pressure chamber 11.

The first pressure chamber 11 and the second pressure chamber 12 are separated by the plate like member 10. The formation of the second pressure chamber 12 at the side of the first pressure chamber 11 means that another pressure chamber 13 corresponds to the second pressure chamber 12 when any one of the aforementioned plurality of pressure chambers 13 shall be the first pressure chamber 11.

The driving piezoelectric element 60 of the basic structure is provided above the first pressure chamber 11 and above the vibration plate 30. Further, the non driving piezoelectric element 62 is provided above the second pressure chamber 12 and above the vibration plate 30. When the driving piezoelectric element 60 is provided above the first pressure chamber 11, another non driving piezoelectric element 62 different from the non driving piezoelectric element 62 above the second pressure chamber 12 provided at the side of the first chamber 11 can be newly provided above the first pressure chamber 11. Similarly, when the non driving piezoelectric element 62 is provided above the second pressure chamber 12, another driving piezoelectric element 60 different from the driving piezoelectric element 60 above the first pressure chamber 11 provided at the side of the second chamber 12 can be also newly provided above the same second pressure chamber 12.

The non driving piezoelectric element 62 is provided above the second pressure chamber 12 provided at the side of the first pressure chamber 11 above which the driving piezoelectric element 60 is provided in the liquid ejecting head 100 having such a basic structure. Accordingly, vibration of the vibration plate 30 above the second pressure chamber 12 can be restrained. Herewith, ejection of liquid from the second pressure chamber 12 is restrained when liquid is ejected from the first pressure chamber 11 by the operation of the driving piezoelectric element 60, so that crosstalk is restrained.

2. Manufacturing Method of Liquid Ejecting Head

An example of a manufacturing method of the liquid ejecting head 100 will be described below.

The pressure chamber 13 is formed by assembling the plate like member 10, the nozzle plate 20, and the vibration plate 30. A mask pattern is formed on a silicon substrate by using a photolithographic method and the silicon substrate is etched through the mask pattern for patterning to form the plate like member 10. The nozzle plate 20 can be manufactured by, for example, cutting a stainless plate and opening the nozzle orifice 22 at a predetermined position. As for the vibration plate 30, for example, a commercially available polyimide film can be used. The members are laminated in the order of the nozzle plate 20, the plate like member 10, and the vibration plate 10 to form the pressure chamber 13.

The driving piezoelectric element 60 and the non driving piezoelectric element 62 are manufactured by performing dicing, etching, and the like to piezoelectric elements having a predetermined size which are preliminarily formed on a housing not shown by a known method. Wirings for the electrodes of the driving piezoelectric element 60 can be provided by a known method.

When providing the support plate 40 and the diaphragm 50, the support plate 40 and the diaphragm 50 can be simultaneously manufactured by, for example, etching the circumference of the diaphragm 50 by using a photolithographic method after a stainless plate is preliminarily bonded with the vibration plate 30 by an appropriate adhesive agent. Through hole 42 and the diaphragm 50 are formed by the etching. Note that the support plate 40 and the diaphragm 50 can be separately manufactured.

The liquid ejecting head 100 can be manufactured by disposing the aforementioned members at predetermined positions by using known positioning means or the like and assembling the members by using an adhesive agent or the like as necessary.

3. Operation and Effect

The liquid ejecting head 100 of the embodiment is the one in which crosstalk is restrained.

In the liquid ejecting head 100 of the embodiment, the vibration plate 30 above the other pressure chamber 13 which does not eject liquid is mechanically reinforced by the non driving piezoelectric element 62 when liquid is ejected from the pressure chamber 13 having the driving piezoelectric element 60 thereabove. Consequently, the vibration plate 30 above the pressure chamber 13 that does not eject liquid becomes difficult to receive the influence of the vibration therearound. Herewith crosstalk is reduced.

Further, in the liquid ejecting head 100 of the embodiment, the driving piezoelectric element 60 and the non driving piezoelectric element 62 can be disposed above one pressure chamber 13. Herewith, for one pressure chamber 13, when vibrating a part of the vibration plate 30 by the driving piezoelectric element 60, the deformation of the other portion of the vibration plate 30 above the pressure chamber 13 is restrained by the non driving piezoelectric element 62. Consequently, needless ejection of liquid is restrained, and crosstalk can be reduced.

4. Printer

Next, a printer 600 having the aforementioned liquid ejecting head 100 will be described. Herein, the case where the printer 600 according to the embodiment is an ink jet printer will be described.

Figure 8:
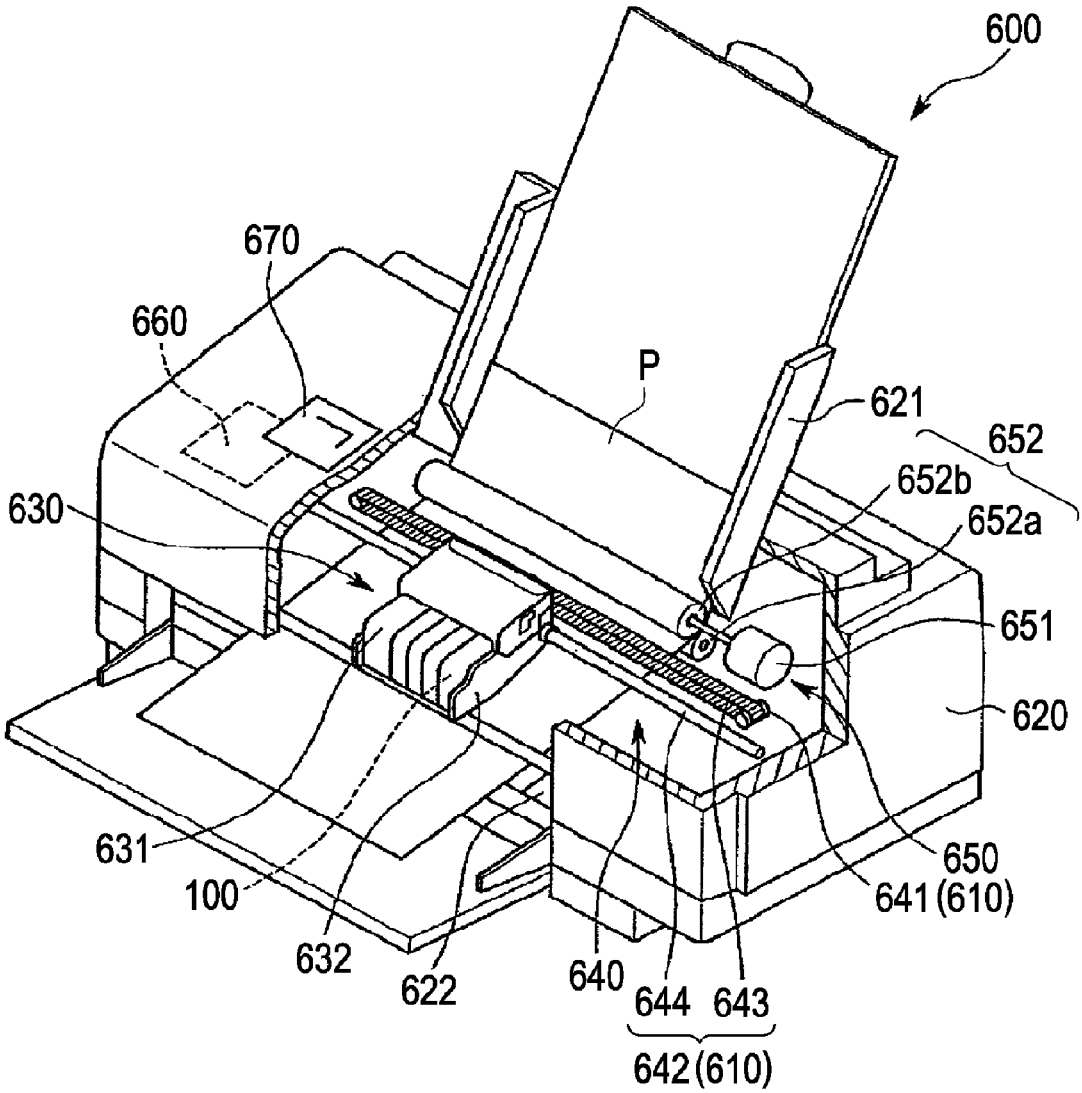
FIG. 8 is a perspective view roughly showing a printer 600 of the embodiment.

FIG. 8 is a perspective view roughly showing the printer 600 according to the embodiment. The printer 600 includes a head unit 630, a driving unit 610, and a control unit 660. Further, the printer 600 may include a device main body 620, a paper feed unit 650, a tray 621 for placing a recording paper P, an outlet 622 for discharging the recording paper P, and an operation panel 670 disposed on the upper surface of the device main body 620.

The head unit 630 has an ink jet type recording head (hereinafter, also simply referred to as a "head") constituted by the above described liquid ejecting head 100. The head unit 630 is further equipped with an ink cartridge 631 that supplies ink to the head, and a carrying unit (carriage) 632 that mounts the head and the ink cartridge 631.

The driving unit 610 can reciprocate the head unit 630. The driving unit 610 has a carriage motor 641 which becomes a driving source of the head unit 630 and a reciprocating mechanism 642 for reciprocating the head unit 630.

The reciprocating mechanism 642 is equipped with a carriage guide axis 644 whose both ends are supported by frames (not shown), a timing belt 643 extending in parallel to the carriage guide axis 644. The carriage 632 that can be freely reciprocated is supported by the carriage guide axis 644. Further, the carriage 632 is fixed to a part of the timing belt 643. If the timing belt 643 is driven by the operation of the carriage motor 641, the head unit 630 reciprocates by the guide of the carriage guide axis 644. During the reciprocating movement, ink is appropriately ejected from the head, and printing on the recording paper P is performed.

The control unit 660 is capable of controlling the head unit 630, the driving unit 610, and the paper feed unit 650.

The paper feed unit 650 is capable of feeding the recording paper P to the side of the head unit 630 from the tray 621. The peer feed unit 650 is equipped with a paper feed motor 651 which becomes a driving source thereof and a paper feed roller 652 that rotates by the actuation of the paper feed motor 651. The paper feed roller 652 is equipped with a driven roller 652*a* and a driving roller 652*b* which are opposed up and down with a pathway of the recording paper P interposed therebetween. The driving roller 652*b* is coupled with the paper feed motor 651.

The head unit 630, the driving unit 610, the control unit 660, and the paper feed unit 650 are provided inside the device main body 620.

In the above described example, the case in which the printer 600 is the ink jet printer is described. However, it should be noted here that the printer of the invention can be used as a liquid drop ejecting device for industrial use. In this case, as for the liquid (liquid-like material) to be ejected, the one can be used in which various functional materials are prepared to an appropriate viscosity by a solvent of a disperse medium.

The printer 600 of the embodiment has the liquid ejecting head 100 at the recording head portion, so that the printer 600 has an excellent coating capability of a liquid drop with respect to an object to be printed. That is, crosstalk of a liquid drop is restrained during printing. Accordingly, a needles coating is reduced and accuracy of coating position is enhanced in a printed product.

The invention includes a structure which is substantially the same as the structure described in the embodiment (for example, the structure having the same function, method, and result, or the structure having the same object and effect). Further, the invention includes a structure in which a part which is not essential of the structure described in the embodiment is replaced. Further, the invention includes a structure which can attain the same operation and effect or a structure that can achieve the same object as those of the structure described in the embodiment. Further, the invention includes a structure in which a publicly known technology is added to the structure described in the embodiment.

What is claimed is:

1. A liquid ejecting head comprising:

a first pressure chamber;

a second pressure chamber provided at a side of the first pressure chamber;

a vibration plate provided above the first pressure chamber and the second pressure chamber;

a driving piezoelectric element provided above the first pressure chamber and above the vibration plate;

a non-driving piezoelectric element provided above the second pressure chamber and above the vibration plate; and a support plate provided above the vibration plate and equipped with a through hole, wherein the through hole is provided above the first pressure chamber such that a bottom portion of the driving piezoelectric element is at least partially provided inside the through hole and no portion of the non-driving piezoelectric element is provided inside the through hole.

2. The liquid ejecting head according to claim 1, wherein each of the first pressure chamber and the second pressure chamber is a space surrounded by the vibration plate, a plate like member which becomes a partition wall between the first pressure chamber and the second pressure chamber, and a nozzle plate provided below the plate like member and equipped with a nozzle orifice.

3. The liquid ejecting head according to claim 1, further comprising:

another non driving piezoelectric element provided above the first pressure chamber and above the vibration plate.

4. The liquid ejecting head according to claim 1, comprising:

another driving piezoelectric element provided above the second pressure chamber and above the vibration plate.

5. The liquid ejecting head according to claim 1, further comprising:

a support plate provided above the vibration plate and equipped with a through hole, and a diaphragm provided above the vibration plate and provided inside the through hole.

6. A printer comprising the liquid ejecting head according to claim 1.

7. The liquid ejecting head according to claim 2, further comprising:

another non driving piezoelectric element provided above the first pressure chamber and above the vibration plate.

8. The liquid ejecting head according to claim 2, comprising:

another driving piezoelectric element provided above the second pressure chamber and above the vibration plate.

9. The liquid ejecting head according to claim 3, comprising:

another driving piezoelectric element provided above the second pressure chamber and above the vibration plate.

10. The liquid ejecting head according to claim 2, further comprising:

a support plate provided above the vibration plate and equipped with a through hole, and a diaphragm provided above the vibration plate and provided inside the through hole.

11. The liquid ejecting head according to claim 3, further comprising:

a support plate provided above the vibration plate and equipped with a through hole, and a diaphragm provided above the vibration plate and provided inside the through hole.

12. The liquid ejecting head according to claim 4, further comprising:

a support plate provided above the vibration plate and equipped with a through hole, and a diaphragm provided above the vibration plate and provided inside the through hole.

13. A printer comprising the liquid ejecting head according to claim 2.

14. A printer comprising the liquid ejecting head according to claim 3.

15. A printer comprising the liquid ejecting head according to claim 4.

16. A printer comprising the liquid ejecting head according to claim 5.

17. The liquid ejecting head according to claim 1, wherein an end of the non-driving piezoelectric element opposite the second pressure chamber is fixed to a stationary portion of the liquid ejecting head.

* * * * *